US010329769B2

(12) United States Patent
Gelbaum

(10) Patent No.: US 10,329,769 B2
(45) **Date of Patent: *Jun. 25, 2019**

(54) TALL SKYLIGHT DOME WITH SUN SHADE AND DIFFUSING PARTIAL CAP TO STRENGTHEN DOME TO CAPTURE LOW SUN ELEVATION ANGLE LIGHT

(71) Applicant: Entech Solar, Inc, Grapevine, TX (US)

(72) Inventor: David Gelbaum, Costa Mesa, CA (US)

(73) Assignee: Entech Solar, Inc, Krum, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/939,735

(22) Filed: Mar. 29, 2018

(65) Prior Publication Data

US 2018/0238056 A1 Aug. 23, 2018

Related U.S. Application Data

(63) Continuation of application No. 15/612,843, filed on Jun. 2, 2017, now Pat. No. 9,976,308.

(60) Provisional application No. 62/461,379, filed on Feb. 21, 2017.

(51) Int. Cl.
*E04D 13/03* (2006.01)

(52) U.S. Cl.
CPC ..... *E04D 13/033* (2013.01)

(58) Field of Classification Search
CPC ..... E04D 13/03; E04D 13/033; E04D 13/035
See application file for complete search history.

(56) References Cited

U.S. PATENT DOCUMENTS

| | | | |
|---|---|---|---|
| 1,158,626 | A | 11/1915 | Brooks |
| 1,220,219 | A | 3/1917 | Goldman |
| 4,428,358 | A | 1/1984 | Adamson |
| 4,820,020 | A | 4/1989 | Terrill |
| 5,408,795 | A | 4/1995 | Eljadi |
| 5,467,564 | A | 11/1995 | DeKeyser |
| 5,568,832 | A | 10/1996 | Eddy |

(Continued)

FOREIGN PATENT DOCUMENTS

| | | |
|---|---|---|
| WO | 9516100 | 6/1995 |
| WO | 2005005745 | 1/2005 |
| WO | 2012161765 | 11/2012 |

*Primary Examiner* — Patrick J Maestri
(74) *Attorney, Agent, or Firm* — Thomas Coester Intellectual Property

(57) ABSTRACT

The present subject matter comprises a simple, passive skylight dome with relatively tall partially vertical sides comprising partially transparent material which diffuses the transmitted light, and a mostly opaque sun shade near the top of the relatively tall partially vertical sides. The partially vertical sides are able to better intercept sunlight from low sun elevation angles than conventional horizontal skylights. The mostly opaque sun shade is able to block sunlight from high sun elevation angles to prevent such sunlight from entering the building below the dome. By enhancing the collection of low-sun-elevation-angle light, the subject matter improves the daylight performance of the skylight early and late in the day, and all day in the winter months. By reducing the collection of high-sun-elevation-angle light, the subject matter reduces the solar heat gain near solar noon in the summer months, thereby reducing air conditioning loads and related costs.

10 Claims, 7 Drawing Sheets

(56) References Cited

U.S. PATENT DOCUMENTS

| | | | | |
|---|---|---|---|---|
| 5,648,873 | A | 7/1997 | Jaster et al. | |
| 6,219,977 | B1 | 4/2001 | Chao | |
| 6,348,910 | B1 | 2/2002 | Yamamoto et al. | |
| 6,918,216 | B2 * | 7/2005 | Hoy | E04D 13/03 359/591 |
| 7,395,636 | B2 | 4/2008 | Blomberg | |
| 7,410,284 | B2 | 8/2008 | Edmonds | |
| 7,430,077 | B2 | 9/2008 | Briee | |
| 7,639,423 | B2 | 12/2009 | Kinney et al. | |
| 7,982,956 | B2 | 7/2011 | Kinney | |
| 8,797,652 | B2 | 8/2014 | Mosher | |
| 8,934,173 | B2 * | 1/2015 | Vasylyev | G02B 5/0205 359/592 |
| 9,194,128 | B1 | 11/2015 | Fawley | |
| 9,765,522 | B2 | 9/2017 | Bilbrey | |
| 2003/0159364 | A1 | 8/2003 | Piano | |
| 2007/0180789 | A1 | 8/2007 | Valentz | |
| 2010/0132279 | A1 | 6/2010 | Valentz | |
| 2011/0289870 | A1 | 12/2011 | Nemazi | |
| 2013/0314795 | A1 | 11/2013 | Weaver | |

* cited by examiner

TALL SKYLIGHT DOME WITH SUN SHADE AND DIFFUSING PARTIAL CAP TO STRENGTHEN DOME TO CAPTURE LOW SUN ELEVATION ANGLE LIGHT

RELATED APPLICATIONS

This application is a continuation of U.S. application Ser. No. 15/612,843 entitled Tall Skylight Dome with Sun Shade and Diffusing Partial Cap to Strengthen Dome to Capture Low Sun Elevation Angle Light filed 6 Jun. 2017 which claims priority to and is a non-provisional of U.S. Provisional application No. 62/461,379, filed on 21 Feb. 2017 entitled "Tall Skylight Dome with Diffusing Partial Cap to Strengthen Dome to Capture Low Sun Elevation Angle Light", the entirety of which is incorporated herein by reference. This application is related to and incorporates by reference, commonly owned U.S. Pat. No. 9,416,542 filed 16 Sep. 2014 entitled "Passive skylight dome configured to increase light to increase collection at low sun elevations angles and to reduce light at high sun elevation angles."

BACKGROUND

Conventional horizontal skylights suffer from poor sunlight collection when the sun is low in the sky, i.e., when the sun's elevation angle is small. This poor low-sun-elevation angle performance leads to poor lighting in the wintertime in most moderate latitudes, and to poor lighting early and late in the day in all locations. Previous attempts to solve this problem have sometimes used expensive tracking reflectors above the skylight penetration into the building, or sometimes used fixed reflectors or prismatic lenses above the skylight penetration with less than adequate performance.

Conventional horizontal skylights also suffer from excess sunlight collection when the sun is high in the sky, i.e., when the sun's elevation angle is large. This excess sunlight collection during summer months near solar noon increases solar heat gain with corresponding increases in air conditioning loads and costs. Previous attempts to solve this problem have sometimes used expensive blinds and baffles to block some of the excess sunlight collection with less than satisfactory performance, reliability, and cost.

Conventional skylights mounted on conventional curbs suffer from low light collection when the sun is low in the sky, i.e., when the sun's elevation angle is small. For such prior-art skylights, only small amounts of sunlight from low sun elevation angles can be collected by the skylight due to the high incidence angle of the solar rays onto the horizontal plane of the skylight. This defect in prior-art skylights severely limits light collection early and late in the day, and all day long in mid-winter months for high latitudes, when the sun never gets high in elevation angle. Conventional skylights also suffer from excess light collection and solar heat gain in the hours around solar noon in the summer, inflating air-conditioning usage and cost.

Conventional skylights mounted on conventional curbs also suffer from structural weaknesses, especially after the skylight material has aged and embrittled in the outdoor environment, sometimes leading to workers being killed or injured due to falls through such skylights. The weakness of previous skylights has also led to hail penetration into the building below, causing damage to the contents and significant expense for repairs and replacement. Previous attempts to solve this structural weakness problem include adding protective metal grids or cages either over or under such skylights for fall protection, but such grids or cages are expensive and block a considerable amount of light. Other previous attempts to solve this problem include making the skylight dome material thicker, but this requires more material usage and thus adds both expense and weight to the skylight.

An embodiment of the current subject matter uses a relatively tall dome (the inner dome) with an innovative light-diffusing partial cap (the outer dome) over the inner dome where the partial cap extends part of the way down the sides of the dome, but not all the way down the sides of the dome, and the outer dome is bonded to the sides of the inner dome. The partial cap intercepts a substantial amount of the low sun elevation angle light and, by diffusing at least a portion of such light downward, is thereby able to deliver a significant fraction of such low sun elevation angle light into the building below for illumination.

Most low sun elevation angle light striking the inner dome below the level of the partial cap hits the inner dome at a low enough height that it will enter the building and it's not necessary to diffuse it to make a portion of it enter the building. If, instead of the cap, there was an outer diffusing dome covering the entire inner dome, (a common construction in the skylight industry), then low sun elevation angle light striking the lower part of the skylight would suffer a loss in transmittance when it passed through the outer diffusing dome that it doesn't suffer when there's a partial cap and the lower part of the inner dome isn't covered by an outer diffusing dome. Thus, if there was an outer diffusing dome covering the entire inner dome, the collection of low sun elevation angle light would thus be significantly reduced compared to the partial cap covering the top and part of sides of the inner dome.

The partial cap also reduces the collection of high sun elevation light through the part of the dome covered by the cap by reducing transmittance through the top of the dome and by scattering high sun elevation light so that its effective sun elevation angle is reduced and some of it is scattered out of the dome and doesn't make it into the building.

The partial cap also strengthens the dome for fall protection and for hail resistance, at only a fraction of the cost of making the entire dome thicker. Therefore, the disclosed subject matter solves two critical problems in conventional skylights, improving low sun elevation angle sunlight collection and strengthening the skylight for fall protection and hail impact resistance.

The disclosed subject matter can take many different forms. The basic skylight dome can be many different sizes and shapes, and the cap for the dome can likewise be many different sizes and shapes and extents. The disclosed subject matter can also be tailored for a variety of applications, from big-box stores to offices to residences.

The disclosed subject matter is a unique new skylight, using a relatively tall transparent or translucent dome with a partial cap of light-diffusing material to both collect more low sun elevation angle sunlight and to also strengthen the dome for personnel safety, protection of building contents from weather damage, and product longevity. The disclosed subject matter also reduces solar heat gain and associated air-conditioning costs during the mid-day hours in summertime.

The present subject matter uses a relatively tall diffusely transmitting dome to collect low sun elevation light, with a thicker shade near the top of the dome to block high sun elevation light, thereby solving both problems by both increasing inadequate sunlight collection during low sun elevation periods and also by decreasing excess sunlight collection during high sun elevation periods. The present subject matter solves both problems in a totally passive manner, requiring no moving parts and no seasonal change in configuration of the skylight. Therefore, the present subject matter represents a simple, reliable, cost-effective solution to two major problems for horizontal skylights.

This subject matter includes at least one skylight dome with relatively tall partially vertical sides comprising partially transparent material which diffuses the transmitted light, and at least one mostly opaque sun shade near the top of the relatively tall partially vertical sides. The partially vertical sides are able to better intercept sunlight from low sun elevation angles, in contrast to conventional horizontal skylights which are less well able to intercept such low-sun-elevation-angle light. The thicker shaped portion is more opaque because of the thickness than the vertical walls and is able to block sunlight from high sun elevation angles to prevent such sunlight from entering the building below the dome. By enhancing the collection of low-sun-elevation-angle light with the thicker and thus more opaque to surface, the subject matter improves the daylighting performance of the skylight early and late in the day year around, and all day in the winter months of the year. By reducing the collection of high-sun-elevation-angle light, the subject matter reduces the solar heat gain near solar noon in the summer months, thereby reducing air conditioning loads and related costs for equipment and operating energy. The simple passive configuration of the subject matter, with no moving parts and no operational complexity, ensures high reliability and low maintenance.

The disclosed subject matter uses a relatively tall dome (the inner dome) with an innovative light-diffusing partial cap (the outer dome) over the inner dome where the partial cap extends part of the way down the sides of the dome, but not all the way down the sides of the dome, and the outer dome is bonded to the sides of the inner dome. The partial cap intercepts a substantial amount of the low sun elevation angle light and, by diffusing at least a portion of such light downward, is thereby able to deliver a significant fraction of such low sun elevation angle light into the building below for illumination.

Most low sun elevation angle light striking the inner dome below the level of the partial cap hits the inner dome at a low enough height that it will enter the building and it's not necessary to diffuse it to make a portion of it enter the building. If, instead of the cap, there was an outer diffusing dome covering the entire inner dome, (a common construction in the skylight industry), then low sun elevation angle light striking the lower part of the skylight would suffer a loss in transmittance when it passed through the outer diffusing dome that it doesn't suffer when there's a partial cap and the lower part of the inner dome isn't covered by an outer diffusing dome. Thus, if there was an outer diffusing dome covering the entire inner dome, the collection of low sun elevation angle light would thus be significantly reduced compared to the partial cap covering the top and part of sides of the inner dome.

These and many other advantages of the present subject matter will be readily apparent to one skilled in the art to which the invention pertains from a perusal of the claims, the appended drawings, and the following detailed description of preferred embodiments.

DETAILED DESCRIPTION

Figure 1A:
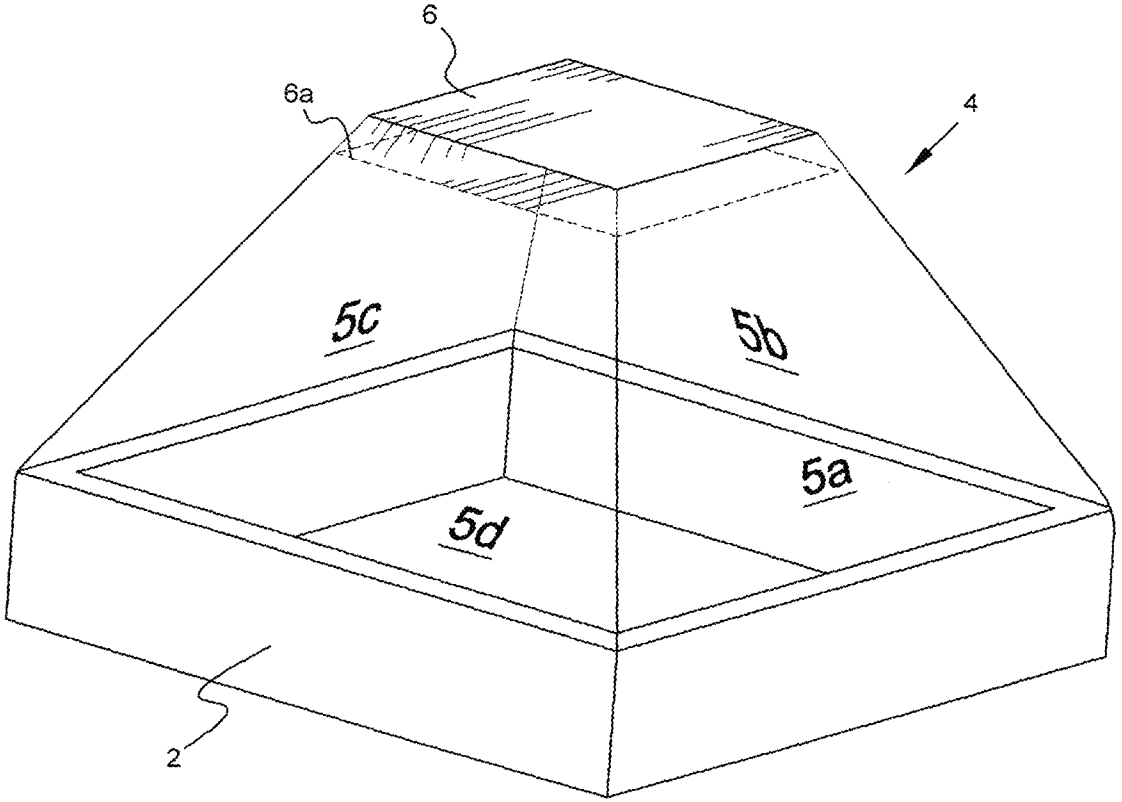
FIGS. 1A, 1B and 1C present a perspective view and top view respectively of one preferred embodiment of the new skylight subject matter, comprising a rectangular geometry for the dome and shade.

The present subject matter is best understood by referring to the attached drawings, which show four preferred embodiments. Referring first to FIG. 1A, the new subject matter is an improved skylight dome, one preferred embodiment of which is shown. The present subject matter will normally comprise a transparent dome 4 which can be a variety of shapes but is shown for example only as a rectangular pyramidal shape in FIG. 1A. The transparent dome 4 can be made from acrylic plastic or polycarbonate plastic or tempered glass. The transparent dome 4 can include surface features such as prisms and/or bulk additives such as white pigment to provide diffusion of the sunlight transmitted into the dome, thereby minimizing glare from direct solar rays. The transparent dome 4 comprises a geometry with partially vertical sides (panes 5*a*-5*d*) able to collect sunlight from low sun elevation angles near the horizon. A thicker top portion 6 is located near the top of the transparent dome 4 to block high-sun-elevation-angle light from entering the building below the dome. The dome 4 with sun shade 6 of FIG. 1A is generally installed on a curb structure 2 which provides support and weatherproofing for the skylight.

For the preferred embodiment shown in FIG. 1A, the transparent dome 4 can be made from impact resistant acrylic plastic, to withstand hail and wind and sunlight exposure. The sun shade (thicker portions) 6 can be made of the same material as the rest of the dome 4, but simply thicker.

As would be apparent to one of ordinary skill in the art, the shape of the dome 4 and the sun shade 6 could comprise a variety of configurations while still providing the basic benefits of the present subject matter, with FIG. 1A showing just one preferred embodiment. FIG. 1A also shows the sun shade 6 may extend on to the partially vertical sides.

Figure 1B:
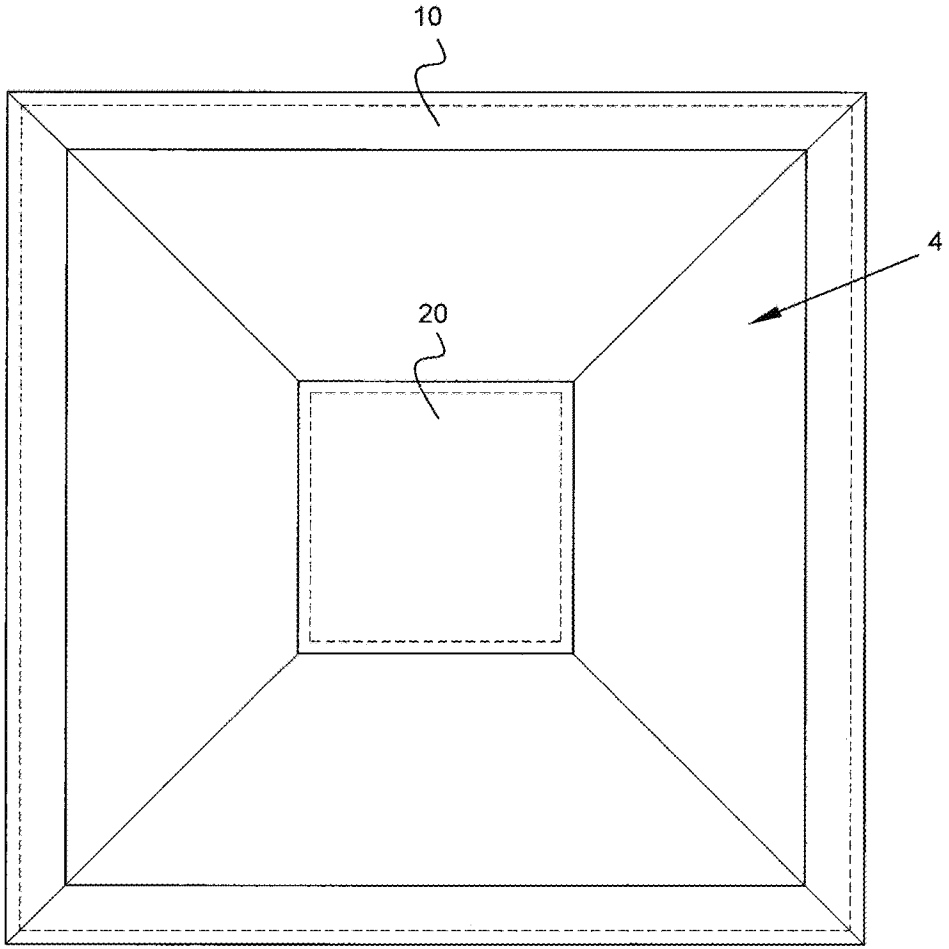

FIG. 1B is a top view of the embodiment of FIG. 1A. The area of the opening in the horizontal plane is generally represented as 10 and the area of the sun shade is generally represented as reference number 20.

Figure 1C:
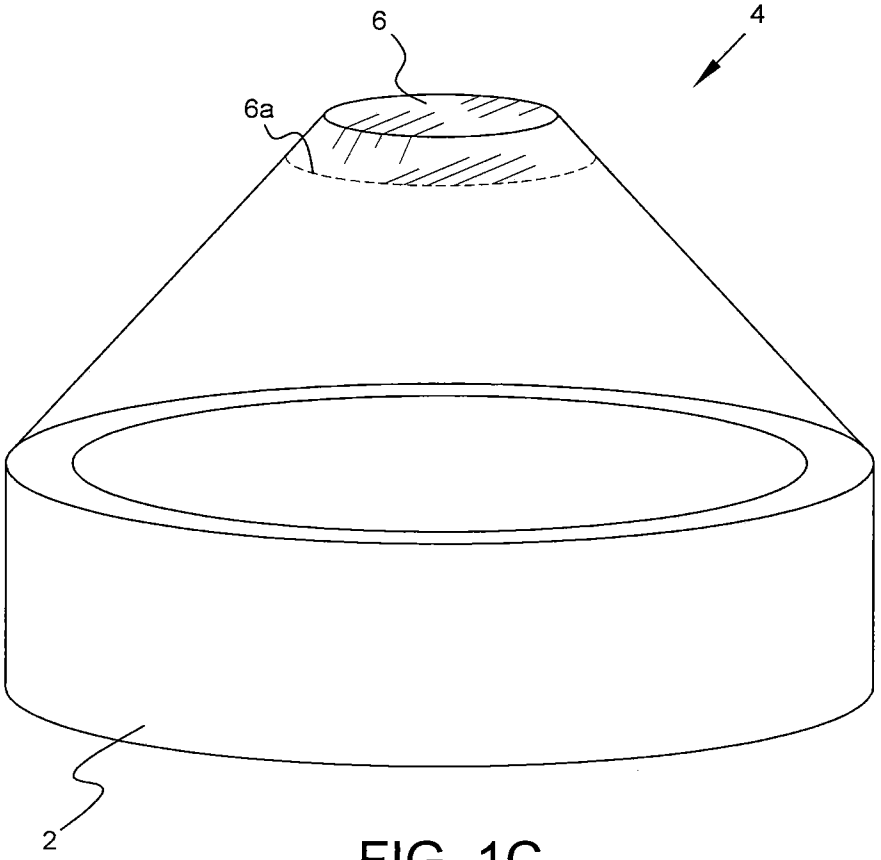

Referring next to FIG. 1C, a second preferred embodiment of the new subject matter is shown in a round geometry. The present subject matter will normally comprise a transparent dome 4 which can be a variety of shapes but is shown for example only as a cylindrical cone shape in FIG. 2. The transparent dome 4 can be made from acrylic plastic or polycarbonate plastic or tempered glass. The transparent dome 4 can include surface features such a prisms and/or bulk additives such as white pigment to provide diffusion of the sunlight transmitted into the dome, thereby minimizing glare from direct solar rays. The transparent dome 4 comprises a geometry with partially vertical sides able to collect sunlight from low sun elevation angles near the horizon. A thicker portion creating a sun shade 6 is located near the top of the transparent dome 4 to block high-sun-elevation-angle light from entering the building below the dome. This sun shade is formed to block vertical light by being thinker than the side or partially vertical panels. The top portion being significantly thicker but made of the same material as the side material. The circular sun shade 6 can have a reflective inner surface, either diffusely reflecting like white paint or specularly reflecting like aluminized film to enhance the delivery to the building below of diffuse light which enters the dome 4. The dome 4 with sun shade 6 of FIG. 2 is generally installed on a curb structure 2 which provides support and weatherproofing for the skylight.

Figure 2:
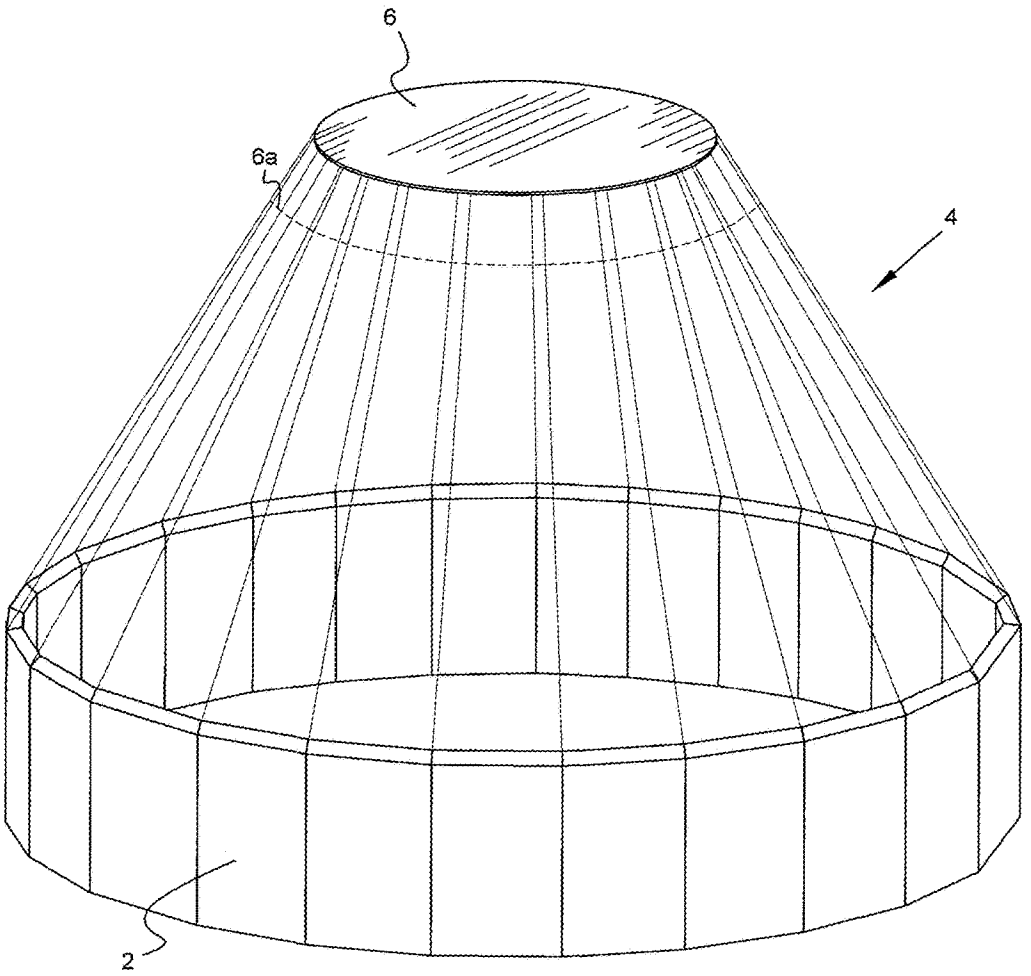
FIG. 2 presents a perspective view of a second preferred embodiment of the skylight subject matter, comprising a circular geometry for the dome and shade.

For the second preferred embodiment shown in FIG. 2, the transparent dome 4 can be made from impact resistant acrylic plastic, to withstand hail and wind and sunlight exposure. The sun shade 6 can be made of the same material as the rest of the dome 4. As would be apparent to one of ordinary skill in the art, the shape of the dome 4 and the sun shade 6 could comprise a variety of configurations while still providing the basic benefits of the present subject matter, with FIG. 1C showing just one preferred embodiment.

Figure 3:
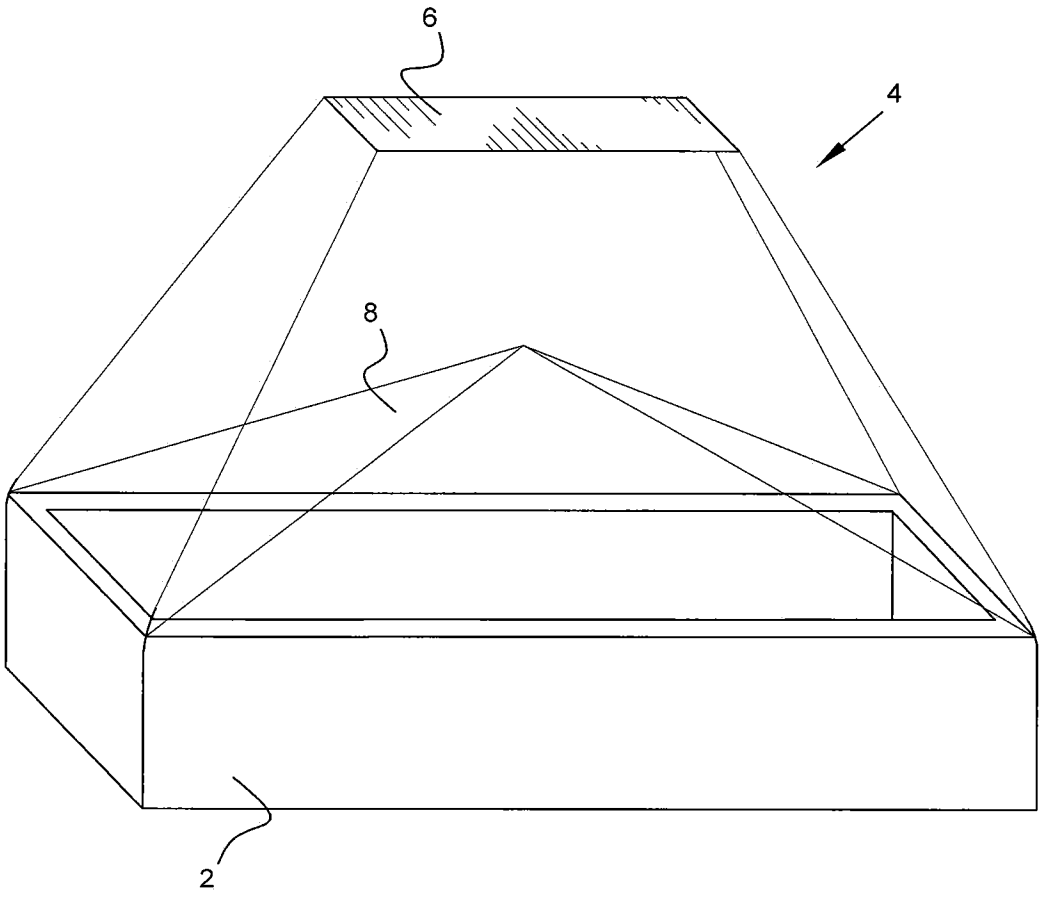
FIG. 3 presents a perspective view of a third preferred embodiment of the new skylight subject matter, comprising a rectangular geometry for the dome and shade, with a second interior dome for the better thermal performance.

Referring next to FIG. 3, a third preferred embodiment of the new subject matter is shown in a rectangular geometry. The present subject matter will normally comprise a transparent dome 4 which can be a variety of shapes but is shown for example only a rectangular pyramidal shape in FIG. 3. The transparent dome 4 can be made from acrylic plastic or polycarbonate plastic or tempered glass. The transparent dome 4 can include surface features such as prisms and/or bulk additives such as white pigment to provide diffusion of the sunlight transmitted into the dome, thereby minimizing glare from direct solar rays. The transparent dome 4 comprises a geometry with partially vertical sides to collect sunlight from low sun elevation angels near the horizon. A thicker portion forming the sun shade 6 as previously described is located near the top of the transparent dome 4 to block high-sun-elevation-angle light from entering the building below the dome. The rectangular sun shade 6 can have a reflective inner surface, either diffusely reflecting like white paint or specularly reflecting like aluminized film, to enhance the delivery to the building below of diffuse light which enters the dome 4. The dome 4 with sun shade 6 of FIG. 3 is generally installed on a curb structure 2 which provides support and weatherproofing for the skylight.

For the third preferred embodiment shown in FIG. 3, the transparent dome 4 can be made from impact resistant acrylic plastic, to withstand hail and wind and sunlight exposure. The sun shade 6 can be made of the same material as the rest of the dome 4.

The primary difference between the third embodiment shown in FIG. 3 compared to the first embodiment shown in FIG. 1A is the addition of a second dome 8 to the skylight configuration. This secondary dome 8 can be placed beneath the dome 4 to reduce the heat loss from the building in the winter months, and to reduce the heat gain into the building in the summer months. This secondary dome 8 can be clear or diffuse in terms of transmitting sunlight. The secondary dome 8 may be made of the same material or may be of another material since it does not need to be protected from the environment.

As would be apparent to one of ordinary skill in the art, the shape of the dome 4, the second dome 8, and the sun shade 6 could comprise a variety of configurations while still providing the basic benefits of the present subject matter, with FIG. 3 showing just one preferred embodiment.

Figure 4:
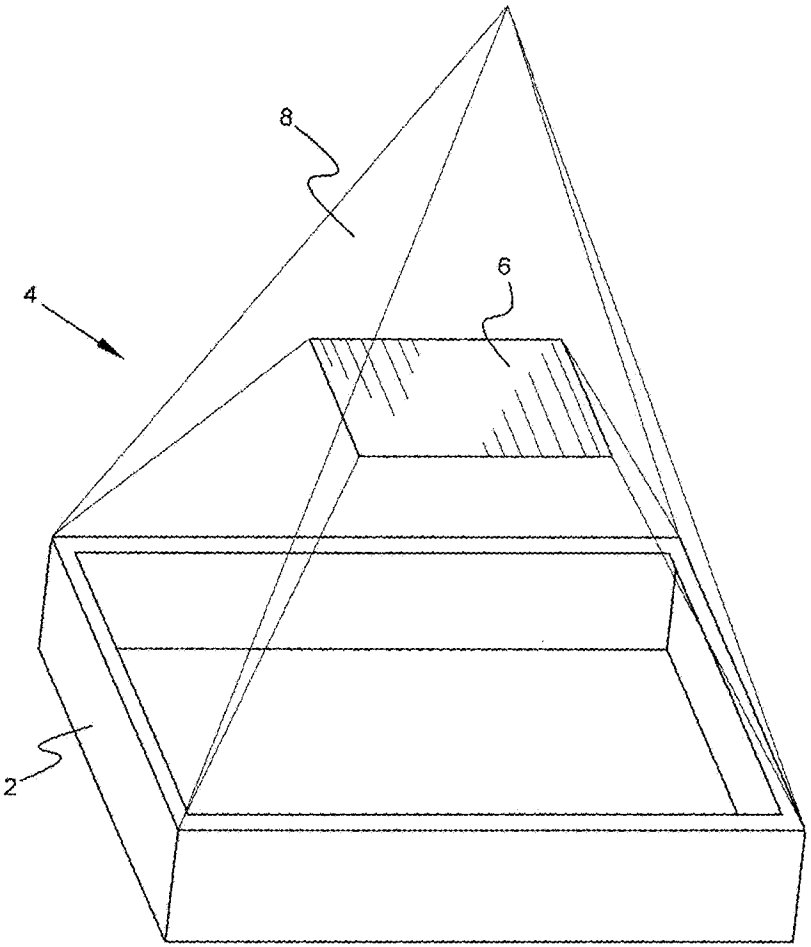
FIG. 4 presents a perspective view of a third preferred embodiment of the new skylight subject matter, comprising a rectangular geometry for the dome and shade, with a second exterior dome for better thermal performance.

Referring next to FIG. 4, a fourth preferred embodiment of the new subject matter is shown in a rectangular geometry. The present subject matter will normally comprise a transparent dome 4 which can be a variety of shapes but is shown for example only as a rectangular pyramidal shape in FIG. 4. The transparent dome 4 can be made from acrylic plastic or polycarbonate plastic or tempered glass. The transparent dome 4 can include surface features such as prisms and/or bulk additives such as white pigment to provide diffusion of the sunlight transmitted into the dome, thereby minimizing glare from direct solar rays. The transparent dome 4 comprises a geometry with partially vertical sides able to collect sunlight from low sun elevation angels near the horizon. A thicker portion forming the sun shade 6 is located near the top of the transparent dome 4 to block high-sun-elevation-angle light from entering the building below the dome. The rectangular sun shade 6 can have a reflective, either diffusely reflecting like white paint or specularly reflecting like aluminized film, inner surface to enhance the delivery to the building below of diffuse light which enters the dome 4. The dome 4 with sun shade 6 of FIG. 4 is generally installed on a curb structure 2 which provides support and weatherproofing for the skylight.

For the fourth preferred embodiment shown in FIG. 4, the transparent dome 4 can be made from impact resistant acrylic plastic, to withstand hail and wind and sunlight exposure.

The primary difference between the fourth embodiment shown in FIG. 4 compared to the first embodiment shown in FIG. 1A is the addition of a second dome 8 to the skylight configuration. This secondary dome 8 can be placed above the dome 4 to reduce the heat loss from the building in the winter months, and to reduce the heat gain into the building in summer months. This outer second dome 8 can be clear or diffuse in terms of transmitting sunlight. Additionally, the volume between the first and second dome may be filled with a gas such as air, or may be filled with an insulating gas, such as argon, carbon dioxide, CF4, or SF6 to further improve the insulating properties of the skylight. This same introduction of insulating gas is also envisioned as being beneficial to the embodiment of FIG. 3.

Figure 5:
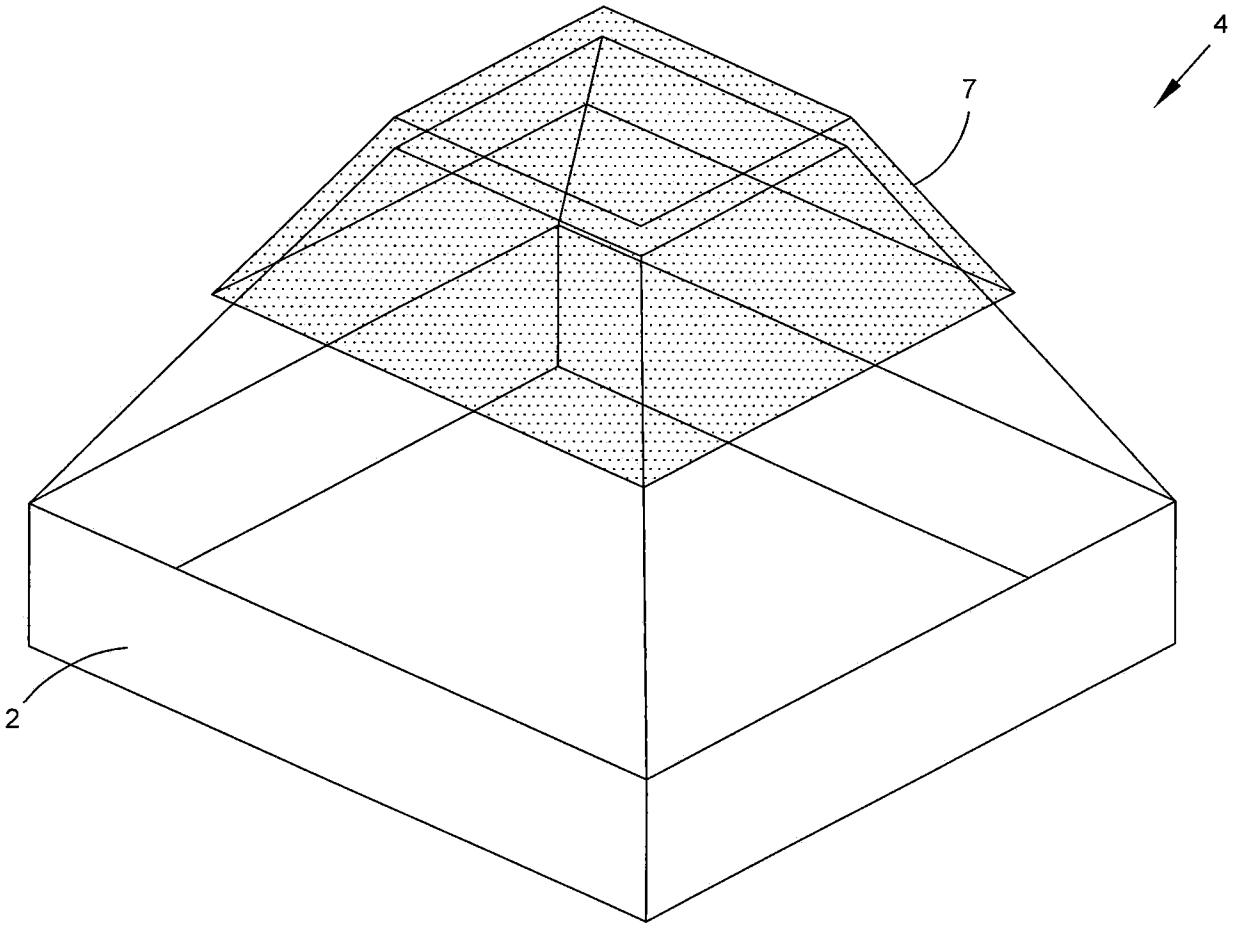
FIG. 5 presents a perspective view of one preferred embodiment of the new skylight, including the curb on which the skylight is mounted, the relatively tall transparent or translucent dome forming the main light-collecting feature of the skylight, and the light-diffusing partial cap 7 on top of the dome to perform the dual functions of (1) light collection and delivery into the building below of low sun elevation angle sunlight, and (2) structural strengthening of the skylight to not only prevent personnel from falling through the skylight from the roof to the floor of the building, but to also prevent hail penetration of the skylight with likely damage to the contents in the building below.

Another embodiment of the disclosed subject matter is best understood by referring to the attached FIG. 5. Referring to the isometric view of FIG. 1, the new curved skylight comprises three key elements: (1) a skylight curb 2 for mounting the skylight to the roof of the building, (2) a light-transparent or light-translucent dome 4 for collecting daylight from the sky, and (3) a light-diffusing partial cap 7 instead or in combination with the sun shade for collecting sun elevation angle light and delivering part of this light to the building below. The partial cap 7 also provides an extra layer of strengthening to the skylight, thereby preventing personnel falls through the skylight and thereby also minimizing hail penetration to the skylight and consequential damage to the contents of the building below. The relatively tall dome 4 is made of transparent or translucent material, such as acrylic plastic, polycarbonate plastic, or glass. The cap 7 is made of light-diffusing material, such as acrylic plastic, polycarbonate plastic, or glass with prisms or surface roughness or added particles or pigments to diffuse light that intercepts the cap.

Those of ordinary skill in the art will understand that the cap 7 can be attached to the dome 4 in a variety of ways. While not specifically shown in FIG. 5, the preferred method of attachment of the cap 7 to the dome 4 will provide a dead air space between the cap 7 and the dome 4, and a seal around the bottom joint between the cap 7 and the dome 4 to preclude dust and dirt infiltration into the dead air space. The method of attachment can therefore include spacers adhesively bonded to both the cap 7 and the dome 4, and sealant such as clear silicone caulk around the inner bottom edge of the cap 7 to fill and seal the space between the cap 7 and the dome 4.

The preferred embodiment of the new skylight in FIG. 5 is merely exemplary, and the configuration can be modified by those of ordinary skill of the art to perform the functions taught by this invention, while still falling within the scope and spirit of this invention. For example, the rectangular skylight geometry of FIG. 5 could be modified to be round or hexagonal or any other shape and still employ the diffusing partial cap to obtain the key benefits of the new invention. Those of ordinary skill in the art will quickly recognize that these and other variations of the new invention fall within the scope and spirit of the disclosed subject matter.

As would be apparent to one of ordinary skill in the art, the shape of the dome 4, the second dome 8 and the sun shade 6 could comprise a variety of configurations while still providing the basic benefits of the present subject matter, with FIG. 4 showing just one preferred embodiment.

The new skylight subject matter, of the four embodiments shown in FIGS. 1A through 5, and many other embodiments which can be conceived by those of ordinary skill in the art, offers many advantages over conventional skylights of the current state of the art. Unlike far more expensive skylight units which use motors and mechanisms to orient mirrors under the dome to help collect low sun elevation angle light, the new subject matter uses simpler, cheaper, passive means to accomplish the same objective. Unlike other less effective skylight units which use curved mirrors or prismatic lenses, the new subject matter uses simple, partially vertical, light-transmitting and light-diffusing surfaces to accomplish the same objective. Unlike conventional horizontal skylights, the new subject matter is able to collect far more low-sun-elevation-angle sunlight, providing much higher illumination early and late in the day, and in the wintertime when the sun is low in the sky all day for non-tropical latitudes. The new skylight subject matter thereby saves more energy for conventional electrical lighting, and therefore provides better economics, i.e., better return on investment and faster payback time.

An aspect of the current subject matter as discussed above is the relationship of area of the shaded portion to that of the unshaded portion. The subject matter seeks to maximize the collection of low sun elevation light and minimize the entry of high sun elevation light. The area of the sun shade 20 (thicker portion) is less than the area of the opening 20 and preferably greater or equal to the non-shaded area as measured from a projection on a horizontal plane, (greater or equal to half the area of the opening 10). Likewise, in maximizing the low sun elevation light, it is preferable that the height of the transparent dome is equal or greater than one of the width or length of the base, or both. These parameters have a direct effect of minimizing unwanted light and maximizing desired light.

Another aspect of the current subject matter is the use of a one-way reflective material on the inter portion of the transparent dome. The reflective inner coating allows light to pass from the outside into the transparent dome but reflects at least some of the light incident upon it from the interior side. For example, with respect to FIG. 1A, a portion of the light passing through pane 5*a* from the low sun is reflected downward off the reflective interior surface of pane 5*c*, similarly light passing through pane 5*c*, is reflected downward off the interior surface of pane 5*a*. This one-way reflection may be accomplished with thin film filters, coating or polarization. The important aspect of the sun shade is that it reflects/blocks high sun elevation light with the reflection characteristics of interior incident light being secondary to that primary function. With respect to the reflective properties of the transparent dome described above, the reflective material may be incorporated within, on the outside or inside of the panes of the dome. The above reflective properties may be incorporated not only on the dome 4, but also in the secondary dome 8.

The new skylight subject matter of the embodiments shown in FIGS. 1A through 5, and of many other embodiments which will be generated by those skilled in the art of skylights based upon this subject matter, also blocks excessive sunlight when the sun is nearly overhead in the summer months. Blocking this excessive light and heat from entering the building will reduce air conditioning loads in the summer, thereby reducing the costs for cooling equipment and the energy to run such equipment. A more comfortable level of illumination will result from this shading of high-sun-elevation-angle light. The building occupants will be more comfortable from the reduced heat and light provided by this simple shade during the hours around solar noon in the hot summer months.

The opening or curb is envisioned as being of several shapes, such as rectangular, square, or polygonal as shown in the Figs. The shape may also be from a cross section of a rotated solid, such as circular or elliptical. In addition, while as shown in the Figs as being a flat separate surface from the wall, the sun shade because of the thickness actually extends down the walls, its lower surface is shown with reference to 6*a* and its projection onto the horizontal plane may be of any practical geometric shape to include rectangular, circular, elliptical, star, cross etc. It is important to note that while not shown in the Figs. the vertical wall portions also have a thickness, but substantially less than the thickness of the shade 6. As described previously, the thicker the given medium the less light transmitted. Thus, the thicker sun shade transmits less light than the thinner vertical wall made of the same material.

While preferred embodiments of the disclosed subject matter have been described, it is to be understood that the embodiments described are illustrative only and that the scope of the invention is to be defined solely by the appended claims when accorded a full range of equivalence. Many variations and modifications naturally occurring to those of skill in the art from a perusal hereof are likewise encompassed.

This current subject matter is simple, easy to manufacture, easy to install, and therefore extremely cost-effective. The invention provides improved performance early and late in the day year-round, and all day long in the winter months for high latitude locations.

This current subject matter improves safety by reducing the probability of people falling through the skylight into the building below.

This current subject matter improves skylight longevity by reducing the probability of hail impact penetration through the skylight, and consequential water damage to the contents of the building below.

What I claim is:

1. A passive skylight comprising:

a plurality of light diffusing sloped sides each having an average thickness, each side of the plurality having a roof edge and a top edge, wherein the roof edges collectively, when installed, circumscribe a roof opening having a first area in a horizontal plane and wherein the top edges define a top perimeter; and a top portion residing within the top perimeter, the top portion formed from a same material as the sloped sides and having an average thickness greater than the average thickness of any of the sloped sides.

2. The passive skylight of claim 1 wherein the plurality of sloped sides defines a gross geometry of a frustum.

3. The passive skylight of claim 1 wherein each sloped side is substantially planar.

4. The passive skylight of claim 1 wherein the plurality of sides and the top portion collectively define a dome having a first gross geometry, further comprising a second dome having second gross geometry different than the first gross geometry.

5. The passive skylight of claim 4 wherein the second dome comprises:

plurality of sloped sides having a slope greater than the slope of the side of the first dome, and wherein the first dome resides within the second dome.

6. The passive skylight of claim 4 wherein the second dome comprises:

plurality of sloped sides having a slope less than the slope of the side of the first dome, and wherein the second dome resides within the first dome.

7. A passive skylight comprising:

a plurality of sloped sides each having an average thickness, each side of the plurality having a roof edge and a top edge, wherein the roof edges collectively, when installed, circumscribe a roof opening having a first area in a horizontal plane and wherein the top edges define a top perimeter; and a diffusive cap formed separately from the sides and coupled to the sides to overlay the top perimeter wherein the diffusive cap has reduced transmittance compared to the sloped sides.

8. The passive skylight of claim 7 wherein the diffusive cap extends partially down the sloped sides.

9. The passive skylight of claim 7 wherein the diffusive cap has an average thickness greater than the average thickness of any of the sloped sides.

10. The passive skylight of claim 1 wherein a perpendicular dimension between the roof edge and the top edge exceeds half of a perpendicular cross dimension of the top portion.

* * * * *